US007630666B2

(12) United States Patent
Nakaya et al.

(10) Patent No.: US 7,630,666 B2
(45) Date of Patent: Dec. 8, 2009

(54) DEVELOPING DEVICE HAVING A SIDE SEAL MEMBER LOCATED BETWEEN A DEVELOPING ROLLER AND A CASE MAIN BODY

(75) Inventors: Yukiko Nakaya, Konan (JP); Mitsuru Horinoe, Aichi-ken (JP); Hiroki Mori, Nagoya (JP); Yuichi Matsushita, Nagoya (JP)

(73) Assignee: Brother Kogyo Kabushiki Kaisha (JP)

( * ) Notice: Subject to any disclaimer, the term of this patent is extended or adjusted under 35 U.S.C. 154(b) by 213 days.

(21) Appl. No.: 11/527,726

(22) Filed: Sep. 27, 2006

(65) Prior Publication Data

US 2007/0071489 A1 Mar. 29, 2007

(30) Foreign Application Priority Data

Sep. 28, 2005 (JP) ..... 2005-282635

(51) Int. Cl.
*G03G 15/08* (2006.01)

(52) U.S. Cl. ..... 399/103; 399/105

(58) Field of Classification Search ..... 399/102, 399/103, 105, 119, 284
See application file for complete search history.

(56) References Cited

U.S. PATENT DOCUMENTS 5,073,797 A 12/1991 Ono et al.
5,212,521 A 5/1993 Ogawa
5,606,397 A 2/1997 Honda et al.
6,336,014 B1 1/2002 Sato
6,980,752 B2 * 12/2005 Kamimura ..... 399/103

FOREIGN PATENT DOCUMENTS

| | | |
|---|---|---|
| DE | 4203271 | 8/1992 |
| EP | 0585882 | 4/1994 |
| EP | 0585882 | 9/1994 |
| JP | 07-134494 | 5/1995 |
| JP | 09-288422 | 4/1997 |
| JP | 09-288422 | 11/1997 |
| JP | 2004020778 | 1/2004 |
| JP | 2004109802 | 4/2004 |

OTHER PUBLICATIONS

First Chinese Office Action for Application No. 2006101421592; Mailed on Sep. 5, 2008.
European Search Report dated May 30, 2008 for Application No. 06020312.2-1240.

* cited by examiner

*Primary Examiner*—Hoang Ngo
(74) *Attorney, Agent, or Firm*—Banner & Witcoff, Ltd.

(57) ABSTRACT

A developing device is provided with a case main body, a developing roller capable of rotating and supporting developer housed in the case main body, an adjustment member extending along a rotation axis direction of the developing roller, and a side seal member. The side seal member comprises a first seal member mounted on the case main body, and a second seal member mounted on the adjustment member. The first seal member and the second seal member are configured separately and make contact with one another.

20 Claims, 7 Drawing Sheets

DEVELOPING DEVICE HAVING A SIDE SEAL MEMBER LOCATED BETWEEN A DEVELOPING ROLLER AND A CASE MAIN BODY

CROSS-REFERENCE TO RELATED APPLICATION

This application claims priority to Japanese Patent Application No. 2005-282635, filed on Sep. 28, 2005, the contents of which are hereby incorporated by reference into the present application.

BACKGROUND OF THE INVENTION

1. Field of the Invention

The present invention relates to a developing device that houses a developer such as toner, etc. Further, the present invention relates to a process cartridge and an image forming device. Further, the present invention relates to a method of manufacturing the developing device.

2. Description of the Related Art

A laser printer, for example, utilizes developer to print on a recording medium (printing paper, for example). The laser printer has a case for housing the developer. The developing device has a case main body in which an opening is formed. A developing roller is coupled, in a manner allowing rotation, to the case main body at a position facing the opening. The developing roller supports the developer housed in the case main body. The laser printer comprises a photoreceptor that makes contact with the developing roller. An electrostatic latent image is formed on a surface of the photoreceptor. The developer that is supported by the developing roller adheres to the part of the photoreceptor that has the electrostatic latent image. The electrostatic latent image of the photoreceptor thus becomes visible. The developer of the photoreceptor is transferred to the recording medium. As a result, words or images are printed on the recording medium.

An adjustment member for adjusting the thickness of the developer supported on the developing roller is fixed with the case main body of the developing device. The adjustment member extends in the rotation axis direction of the developing roller, and adjusts the thickness of the developer across substantially the entire range of the rotation axis direction of the developing roller. By adjusting the thickness of the developer supported on the developing roller, the developer can be supplied at a constant thickness to the photoreceptor from the developing roller. The density of the developer transferred from the developing roller to the photoreceptor is thus constant.

If the developer housed in the developing device leaks to the exterior, devices disposed at the exterior of the developing device will become soiled. It is necessary to form a developing device from which developer cannot leak. U.S. Pat. No. 6,336,014 utilizes a side seal member such that developer does not leak from end parts in the rotation axis direction of the developing roller The case main body has an area that faces a rotation plane of the developing roller at the end part in the rotation axis direction thereof (below, this area will be termed 'facing area of the case main body'). The adjustment member extends in the rotation axis direction of the developing roller. As a result, the adjustment member also has an area that faces the rotation plane of the developing roller at the end part in the rotation axis direction thereof (below, this area will be termed 'facing area of the adjustment member'). The facing area of the case main body and the facing area of the adjustment member are aligned along the rotation direction of the developing roller. In the U.S. Pat. No. 6,336,014, the side seal member has a first elastic member and a second elastic member, the first elastic member being attached to the facing area of the case main body, and the second elastic member being attached to the facing area of the adjustment member. Furthermore, the side seal member has a felt member that passes across both an upper surface (a surface at the developing roller side) of the first elastic member, and an upper surface of the second elastic member. The felt member extends in an integral manner from the upper surface of the first elastic member to the upper surface of the second elastic member. The felt member makes contact with the rotation plane of the developing roller. Therefore, the end part in the rotation axis direction of the developing roller is sealed.

BRIEF SUMMARY OF THE INVENTION

In the aforementioned technique, the side seal member consists of the first elastic member, the second elastic member, and the one felt member that is attached to the upper surfaces of the first elastic member and the second elastic member. The felt member must be attached by being passed across the two elastic members, and consequently the felt member becomes long. Further, the height of the upper surface of the first elastic member may differ from the height of the upper surface of the second elastic member. In this case, a step may be formed between the two elastic members. When there is the step between the two elastic members it is difficult to satisfactorily attach the long felt member that passes across these two elastic members.

It is difficult to satisfactorily attach the long member that passes across the two surfaces if there is even a small step between the two surfaces. As a result, it may happen with the conventional technique that the side seal member cannot be attached in the intended position and shape. The seal becomes less effective if the side seal member is attached in an unintended position or shape, and there is an increased likelihood of developer leaking from the developing device.

The present invention has taken the above situation into consideration, and aims to provide a developing device in which the seal is more effective than in the conventional technique.

A developing device of the present invention comprises a case main body, a developing roller, an adjustment member, and a side seal member. The case main body comprises an opening. The developing roller is attached to the case main body at a position facing the opening. The developing roller is capable of rotating, and is capable of supporting developer housed in the case main body. The adjustment member is coupled with the case main body, and extends along a rotation axis direction of the developing roller. The adjustment member adjusts the thickness of the developer supported by the developing roller.

The case main body comprises a first area facing a rotation plane of the developing roller. The adjustment member comprises a second area facing the rotation plane of the developing roller. The first area and the second area are aligned along a rotation direction of the developing roller. The side seal member comprises a first seal member mounted on the first area and making contact with the rotation plane of the developing roller, and a second seal member mounted on the second area and making contact with the rotation plane of the developing roller. The first seal member and the second seal member are configured separately and make contact with one another.

Since the case main body and the adjustment member are configured separately, there is a high possibility of a step being formed between the first area of the case main body and the second area of the developing roller. In the present invention, it is not necessary to attach a long side seal member that is configured in an integral manner and passes across the two areas that have the step. The first seal member and the second seal member that are configured separately can be mounted separately on the first area of the case main body and the second area of the adjustment member. It is therefore possible to mount the two seal members in the intended position and shape. Although the two seal members are configured separately, they make contact such that there is no space between the two in the rotation direction of the developing roller. An extremely effective seal can therefore be obtained In the developing device of the present invention, a seal with superior effectiveness can be realized.

BRIEF DESCRIPTION OF THE INVENTION

Figure 9:
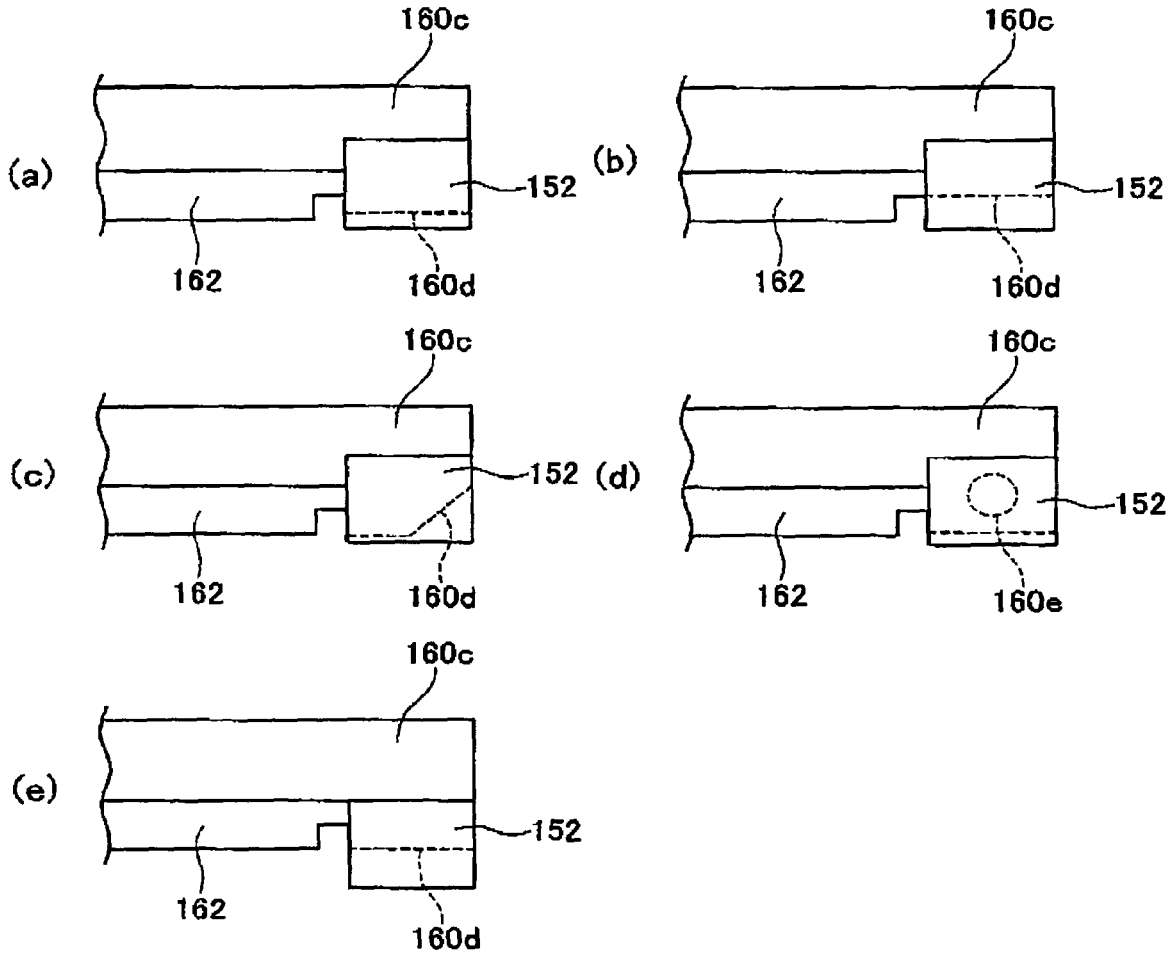

FIG. 9(*a*) shows a simplified view of the developer cartridge. FIG. 9(*b*) shows a variant of the present embodiment. FIG. 9(*c*) shows a variant of the present embodiment. FIG. 9(*d*) shows a variant of the present embodiment. FIG. 9(*e*) shows a variant of the present embodiment.

Figure 10:
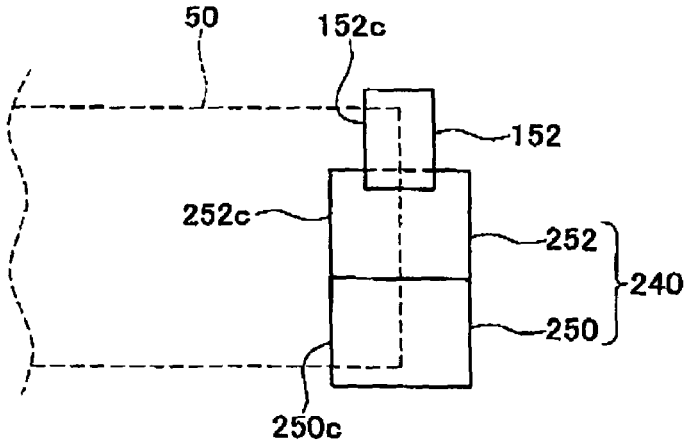

FIG. 10 shows a variant of the present embodiment

DETAILED DESCRIPTION OF THE INVENTION

Embodiments

Figure 1:
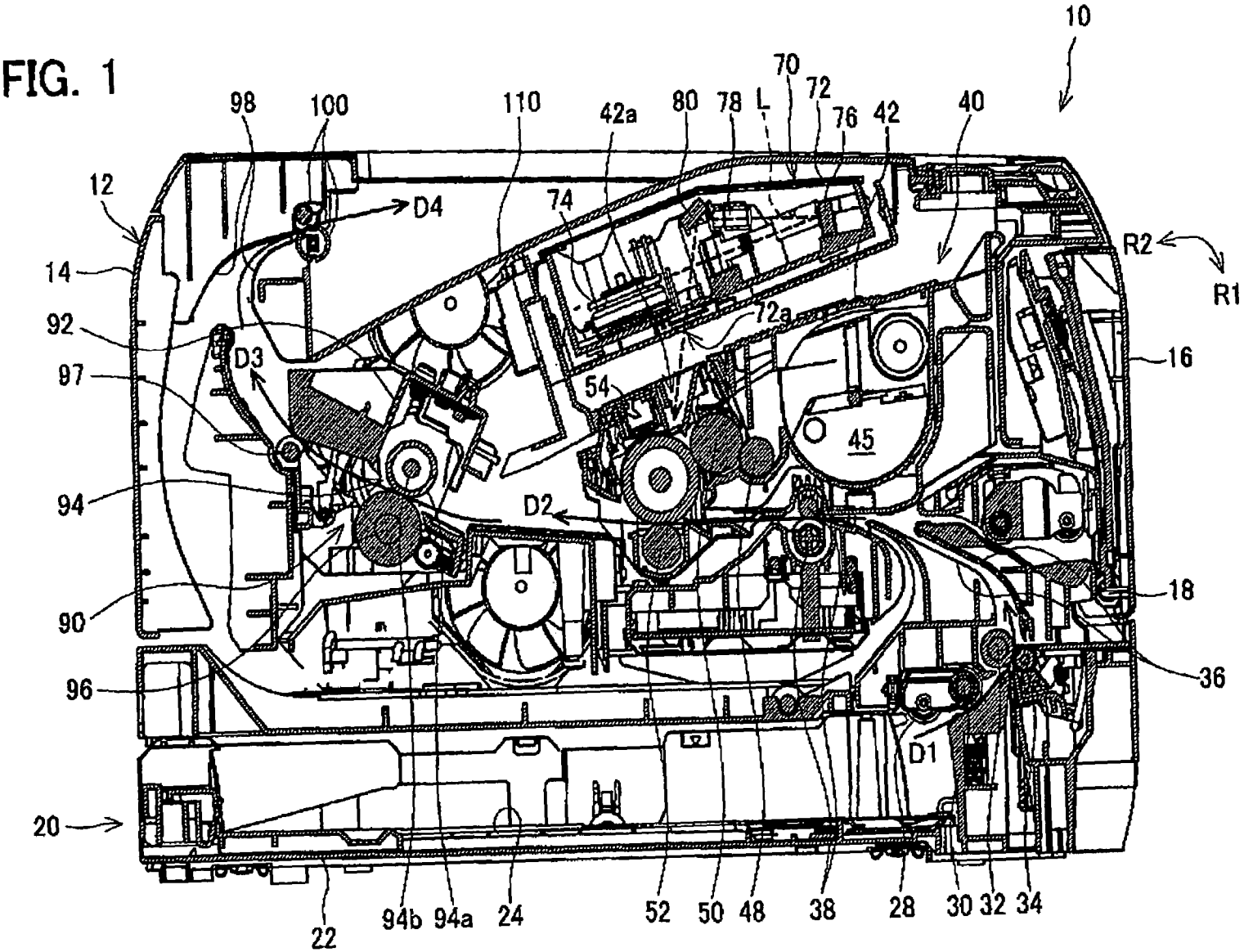
FIG. 1 shows a cross-sectional view of a laser printer of the present embodiment.

An embodiment of the present invention will now be described with reference to the drawings. FIG. 1 shows a cross-sectional view of a laser printer 10 of the present embodiment, Below, the laser printer 10 may be abbreviated to printer 10. In the present embodiment, the right direction of FIG. 1 is a front side of the printer 10.

The printer 10 has a casing 12. The casing 12 comprises a plurality of plate shaped members. In FIG. 1, a posterior cover member 14, an anterior cover member 16, etc. are shown as members included in the casing 10. The anterior cover member 16 can pivot in the direction of the arrow R1 or the arrow R2 with an axis 18 at the center. The casing 12 is opened when the anterior cover member 16 is pivoted in the direction of the arrow R1. In this state, a process cartridge 40 (to be described) can be exchanged. The casing 12 is closed when the anterior cover member 16 is pivoted in the direction of the arrow R2.

The printer 10 comprises a paper supply device 20, the process cartridge 40, an exposure device 70, a toner fixing device 90, etc These devices 20, 40, 70, and 90 are disposed within the casing 12. The devices 20, 40, 70, and 90 will be described in sequence below.

The paper supply device 20 has a paper supply tray 22, four rollers 28, 30, 32, and 34, etc. Printing paper (not shown) is stacked in the paper supply tray 22. The paper supply tray 22 comprises a base plate 24 on which the stacked printing paper is mounted The uppermost sheet of the printing paper stacked on the base plate 24 makes contact with the paper supply roller 28. When the paper supply device 20 is in a housed state within the casing 12, a front end part (the end part at the right side of FIG. 1) of the base plate 24 is energized upwards by a mechanism (not shown). As a result, only tee front end part of the base plate 24 is raised when the number of sheets of printing paper has become smaller. With this configuration, the uppermost sheet of the printing paper can always be kept in contact with the paper supply roller 28.

The paper supply roller 28 is connected with a driving source (not shown). The paper supply roller 28 can rotate in a counterclockwise direction. When the paper supply roller 28 rotates, the uppermost sheet of the printing paper housed in the paper supply tray 22 is transferred to the right (in the direction of the arrow D1). The printing paper that has been transferred to the right makes contact with the separating roller 30. The separating roller 30 is not connected with a driving source. The separating roller 30 is driven in a counterclockwise direction by making contact with the printing paper. When a plurality of sheets of printing paper have been transferred, the separating roller 30 separates these sheets so that only one of the sheets will be transferred downstream The printing paper that has passed the separating roller 30 is sent between the pinch roller 32 and the paper dust removal roller 34.

The pinch roller 32 and the paper dust removal roller 34 are not connected with a driving source. The pinch roller 32 is energized towards the paper dust removal roller 34 by an energizing means (not shown). The pinting paper located between the pinch roller 32 and the paper dust removal roller 34 is pressed against the paper dust removal roller 34 by the pinch roller 32. The paper dust removal roller 34 is capable of removing paper dust adhering to the printing paper that makes contact with the paper dust removal roller 34. The printing paper is transferred along a rail 36 and enters between two resist rollers 38.

The lower resist roller 38 is connected with a driving source (not shown). By rotating in a counterclockwise direction, the lower resist roller 38 can transfer the printing paper in the direction of the arrow D2. The upper resist roller 38 is driven by making contact with the printing paper that is being transferred by the lower resist roller 38, and rotates in a clockwise direction.

Words or images are printed on the printing paper while the printing paper is being transferred in the direction of the arrow D2 by the resist rollers 38. Specifically, printing is performed by the process cartridge 40, the exposure device 70, and the fixing device 90.

The process cartridge 40 is S attached removably to the casing 12. When the anterior cover member 16 is opened (in the direction of the arrow R1), the process cartridge 40 can be removed from the casing 12. An old process cartridge 40 can be exchanged for new one.

The configuration of the process cartridge 40 will be described in detail later. Here, the configuration will be described simply. The process cartridge 40 comprises a casing 42. A through hole 42*a* is formed in an upper surface of the casing 42. A toner chamber 45 is formed at a right side in the casing 42. Toner is housed in the toner chamber 45. Three rollers 48, 50, and 52, and a photoreceptor drum 54 are disposed at a left side in the casing 42. The rollers 48, 50, and 52, and the drum 54 are each connected with a driving source (not shown). The roller 48, which is further to the right, will be termed a supply roller. A developing roller 50 is disposed to the left of the supply roller 48. The photoreceptor drum 54 is disposed to the left of the developing roller 50. A transfer roller 52 is disposed below the photoreceptor drum 54. The printing paper that has been transferred in the direction of the arrow D2 by the resist rollers 38 enters between the photoreceptor drum 54 and the transfer roller 52. The photoreceptor drum 54 rotates in a clockwise direction, and the transfer roller 52 rotates in a counterclockwise direction. The printing paper is transferred further to the left (in the direction of the arrow. D2) by the rotation of the photoreceptor drum 54 and the transfer roller 52. Toner that had adhered to the photoreceptor drum 54 is transferred to the printing paper while this printing paper is being transferred toward the left.

The exposure device 70 is disposed above the process cartridge 40. The exposure device 70 is fixed to the casing 12. The exposure device 70 comprises a casing 72. A through bole 72*a* is formed in a bottom surface of the casing 72. A polygon mirror 74, a reflecting mirror 76, a lens 78, a reflecting mirror 80, etc. are provided within the casing 72. The exposure device 70 has a light source (not shown). Laser beams are emitted from the light source based on the content of print data. The laser beams supplied from the light source are polarized by the polygon mirror 74 toward the reflecting mirror 76. The laser beams are reflected from the reflecting mirror 76 and pass through the lens 78. The laser beams that have passed through the lens 78 are reflected from the reflecting mirror 80. The laser beams that have been reflected from the reflecting mirror 80 face downwards out of the casing 72 from the through hole 72*a*. The laser beas that have exited the casing 72 pass through the through hole 42*a* of the casing 42 of the process cartridge 40, and reach the photoreceptor drum 54. The photoreceptor drum 54 is thus exposed to light with a predetermined pattern. The arrow L of FIG. 1 shows the path of the laser beams described above.

Next, the configuration of the toner fixing device 90 will be described. The toner fixing device 90 is disposed to the posterior of the process cartridge 40 (at the left side in FIG. 1). The toner fixing device 90 is provided with a frame 92, a heating roller 94, and a pressure roller 96. The frame 92 supports the heating roller 94 and the pressure roller 96 in a manner allowing rotation.

The heating roller 94 has a metal pipe 94*a* and a halogen lamp 94*b* disposed within the metal pipe 94*a*. The halogen lamp 94*b* heats the metal pipe 94*a*. The heating roller 94 is connected with a driving source (not shown). When the driving source is operating, the heating roller 94 rotates in a clockwise direction. The pressure roller 96 is energized toward the heating roller 94 by a mechanism (not shown). The pressure roller 96 is not connected with a driving source. When the heating roller 94 rotates in a clockwise direction, the pressure roller 96 rotates in a counterclockwise direction following this rotation.

The printing paper that has passed through the process cartridge 40 enters between the heating roller 94 and the pressure roller 96. When the heating roller 94 rotates in a clockwise direction, the printing paper is transferred towards the left between the heating roller 94 and the pressure roller 96. The heating roller 94, which has been heated to a high temperature, heats the printing paper. This heat fixes the toner that has been transferred to the printing paper. The printing paper that has passed through the toner fixing device 90 is transferred upwards and to the left (in the direction of the arrow D3).

A transfer roller 97 is disposed directly below a left end of the frame 92. The transfer roller 97 is supported in a manner allowing rotation by the casing 12. The transfer roller 97 is connected with a driving source (not shown). The transfer roller 97 rotates in a counterclockwise direction. The transfer roller 97 transfers the printing paper that has passed through the toner fixing device 90 further upwards and to the left The printing paper that has been transferred upwards and to the left by the transfer roller 97 is transferred toward the right along a rail 98.

Two paper ejection rollers 100 are disposed to the right of the rail 98. The lower paper ejection roller 100 is connected with a driving source (not shown). The lower paper ejection roller 100 rotates in a clockwise direction The upper paper ejection roller 100 is not connected with a driving source. When the lower paper ejection roller 100 rotates in a clockwise direction, the upper paper ejection roller 100 rotates in a counterclockwise direction following this rotation.

The printing paper that has been transferred by the transfer roller 97 enters between the two paper ejection rollers 100. When the lower paper ejection roller 100 rotates in a clockwise direction, the printing paper that is between the two paper ejection rollers 100 is transferred toward the right. The printing paper is transferred to the exterior of the casing 12. A paper discharge tray 110 is formed at an upper surface of the casing 12. The printing paper that has been transferred to the exterior of the casing 12 is discharged onto the paper discharge tray 110.

Figure 2:
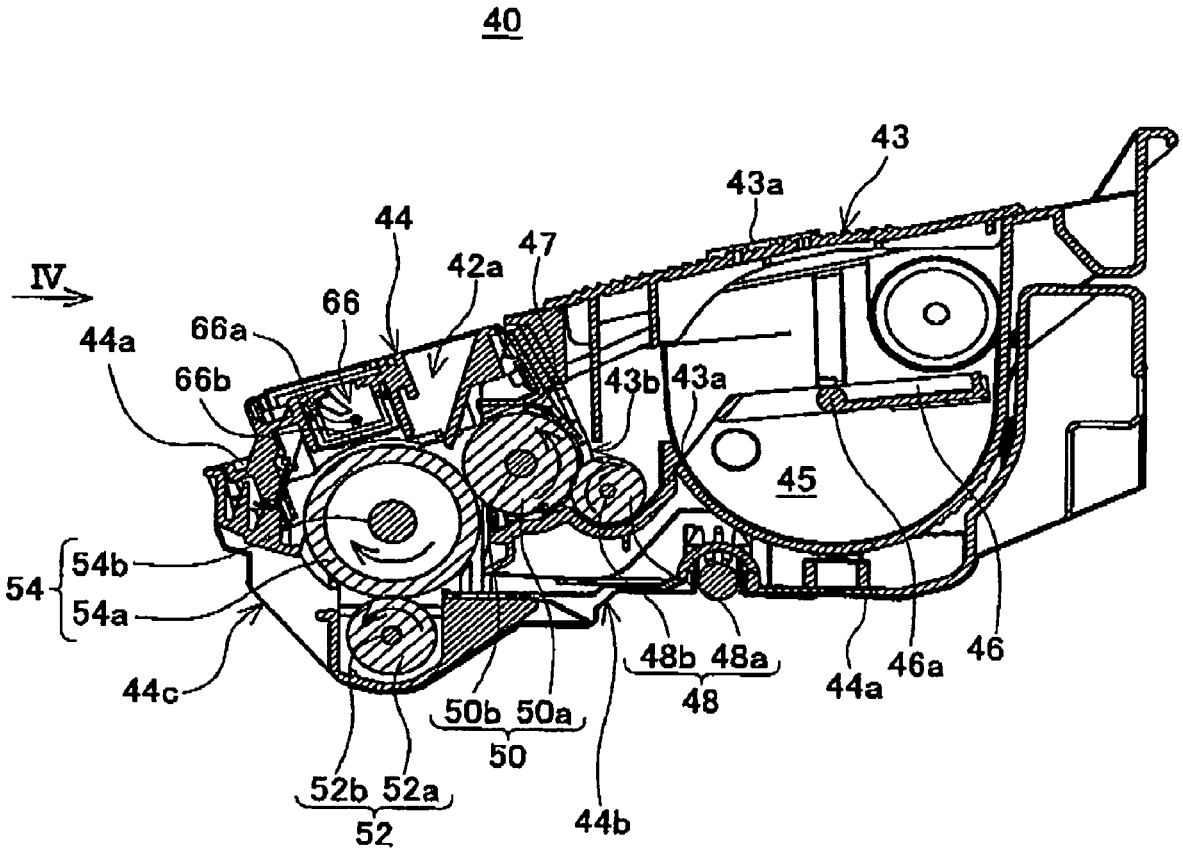
FIG. 2 shows an expanded cross-sectional view of a process cartridge.

A simple description of the configuration of the printer 10 has been given. The manner in which the printing paper is transferred within the casing 12 has also been described. Next, the configuration of the process cartridge 40 will be described in detail with reference to FIG. 2. FIG. 2 shows an expanded cross-sectional view of the process cartridge 40.

Figure 3:
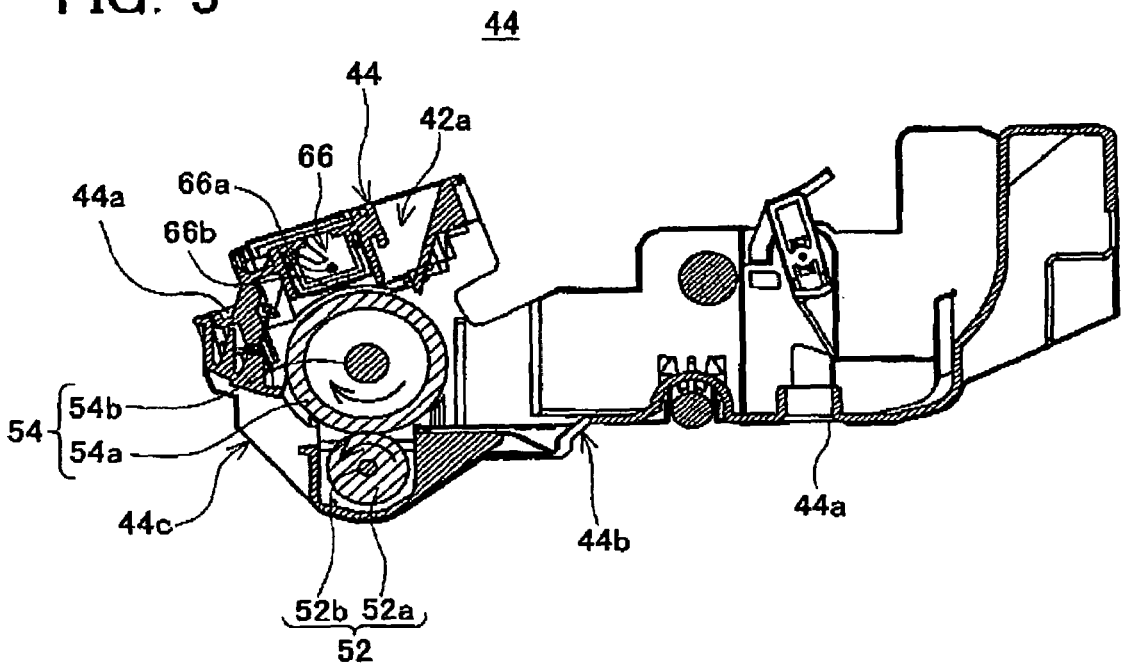
FIG. 3 shows a cross-sectional view of a photoreceptor cartridge.

The process cartridge 40 comprises two cartridges 43 and 44. The cartridge 43, which is disposed at the right, will be termed a developer cartridge. The cartridge 44, which is disposed at the left, will be termed a photoreceptor cartridge. The developer cartridge 43 and the photoreceptor cartridge 44 are connected in a manner allowing separation. FIG. 3 shows a cross-sectional view of the photoreceptor cartridge 44 after the developer cartridge 43 has been separated. It is possible, with this process cartridge 40, to exchange only the developer cartridge 43, or to exchange only the photoreceptor cartridge 44. It is also possible to exchange the entire process cartridge 40.

The configuration of the two cartridges 43 and 44 will be described below. First, the configuration of the photoreceptor cartridge 44 will be described. The photoreceptor cartridge 44 comprises a casing 44*a*. A through hole 42*a* through which the laser beams pass is formed in an upper surface of the casing 44*a*. A transfer entry hole 44*b* through which the printing paper enters is formed in a bottom surface of the casing 44*a*. Further, a transfer exit hole 44*c* through which the printing paper exits is formed in a left side surface of the casing 44*a*. The printing paper enters the photoreceptor cartridge 44 from the transfer entry hole 44*b*, passes between the photoreceptor drum 54 and the transfer roller 52, and exits from the transfer exit hole 44*c*.

The photoreceptor drum 54, the transfer roller 52, and a charger 66 are disposed within the casing 44*a* of the photoreceptor cartridge 44.

The photoreceptor drum 54 makes contact with the developing roller 50 at the left side of this developing roller 50. The photoreceptor drum 54 comprises a photoreceptor drum main body 54*a*, and a photoreceptor drum axis 54*b*. The photoreceptor drum axis body 54*a* has a cylindrical shape. The photoreceptor drum main body 54*a* is a photoreceptor that is positively charged. A surface of the photoreceptor drum main body 54*a* is made from polycarbonate or the like. The photoreceptor drum axis 54*b* is made from metal. The photoreceptor drum axis 54*b* is fixed to the casing 44*a* of the photoreceptor cartridge 44. The photoreceptor drum main body 54*a* is attached in a manner allowing rotation to the photoreceptor drum axis 54*b*. The photoreceptor drum main body 54*a* is connected with a driving source (not shown). The photoreceptor drum main body 54*a* rotates in a clockwise direction.

The transfer roller 52 makes contact with the photoreceptor drum 54 at a lower side thereof. The transfer roller 52 is provided with a transfer roller main body 52*a* and a transfer roller axis 52*b*. The transfer roller main body 52*a* is made from conductive rubber material. The transfer roller axis 52*b* is made from metal. The transfer roller axis 52*b* is attached, in a mariner allowing rotation, to the casing 44*a* of the photoreceptor cartridge 44. The transfer roller axis 52*b* is connected with a driving source (not shown). The transfer roller 52 rotates in a counterclockwise direction. The transfer roller axis 52*b* is connected with a voltage supply circuit (not shown). When transfer is occurring (when the toner that has adhered to the photoreceptor drum 54 is being transferred to the printing paper), bias is applied to the transfer roller 52 from the voltage supply circuit The charger 66 is disposed above the photoreceptor drum 54. A space is formed between the charger 66 and the photoreceptor drum 54. The charger 66 is a scoroton type. The charger 66 comprises a wire 66*a* and a grid 66*b*. The wire 66*a* is a wire extending in a direction perpendicular to the plane of the page of FIG. 2. A high voltage is applied to the wire 66*a*. The grid 66*b* is disposed between the wire 66*a* and the photoreceptor drum 54. Bias voltage is applied to the grid 66*b*. The amount of voltage discharged by the wire 66*a* is thus adjusted. A high voltage is applied to the wire 66*a*, causing a corona discharge, and bias voltage is applied to the grid 66*b*. The surface of the photoreceptor drum 54 (the photoreceptor drum main body 54*a*) is thus positively charged.

Next, the configuration of the developer cartridge 43 will be described. The developer cartridge 43 comprises a case main body 43*a* The toner chamber 45 is formed within the case main body 43*a*. Toner is housed within the toner chamber 45. Positively charged non-magnetic mono-component toner is utilized in the present embodiment. For example, a polymerized toner may be utilized that was obtained by copolymerizing, by means of suspension polymerization, a styrene-type monomer and an acrylic monomer. The acrylic monomer may be acrylic acid, acryl (C1~C4) acrylate, acryl (C1~C4) methacrylate, etc. This polymerized toner has a substantially spherical shape, and has superior flowability. Colorant and wax are mixed into the polymerized toner. Further, an external additive such as silica is added in order to improve flowability.

An agitator 46 is housed within the toner chamber 45. The agitator 46 is attached to the case main body 43*a* in a manner allowing rotation with an axis 46*a* as the center of rotation. The toner within the toner chamber 45 is agitated when the agitator 46 rotates in a clockwise direction. The toner is thus supplied to the supply roller 48.

An opening 43*b* is formed in a left surface of the case main body 43*a*. The opening 43*b* extends in a direction perpendicular to the plane of the page of FIG. 2. The supply roller 48 is disposed at the right side of the opening 43*b*. The developing roller 50 is disposed at the left side of the opening 43*b*.

The supply roller 48 is provided with a supply roller main body 48*a* and a supply roller axis 48*b*. The supply roller main body 48*a* is formed from conductive foam material. The supply roller axis 48*b* is made from metal. The supply roller 48 is supported in a manner allowing rotation by the case main body 43*a* of the developer cartridge 43. The supply roller 48 is connected with a driving source (not shown). The supply roller 48 rotates in a clockwise direction.

The developing roller 50 strongly makes contact with the supply roller 48 at the left side thereof. The developing roller 50 is provided with a developing roller main body 50*a* and a developing roller axis 50*b*. The developing roller main body 50*a* is formed from conductive rubber material. The rubber material can be conductive urethane rubber or silicon rubber containing carbon particles or the like. A surface of the urethane rubber or silicon rubber is covered by urethane rubber or silicon rubber that contains fluorine. The developing roller axis 50*b* is made from metal. A voltage supply circuit (not shown) is connected with the developing roller axis 50*b*. During developing (when the toner is being made to adhere to the photoreceptor drum 54), bias is applied from the voltage supply circuit to the developing roller 50. The developing roller 50 is supported in a manner allowing rotation by the case main body 43*a* in a position facing the opening 43*b*. The developing roller 50 is connected with a driving source (not shown). The developing roller 50 rotates in a counterclockwise direction.

An adjustment member 47 is fixed to the case main body 43*a*. The adjustment member 47 is disposed at the left side of the opening 43*b*. The adjustment member 47 extends in a direction perpendicular to the plane of the page of FIG. 2, and makes contact watch the developing roller 50. The thickness of developer that is formed on the surface of the developing roller 50 is thus adjusted.

Figure 4:
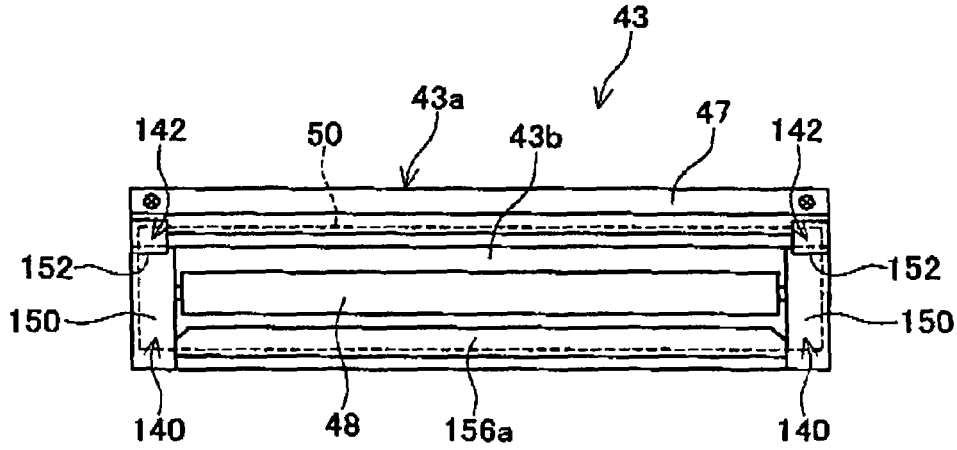
FIG. 4 shows a front view of a developer cartridge viewed from the IV direction of FIG. 2.

FIG. 4 shows a first view of the developer cartridge 43 viewed from the IV direction of FIG. 2. In FIG. 4, the developing roller 50 is shown by a broken line. The developing roller 50 extends in a left-right direction in a position facing the opening 43*b* of the case main body 43*a*. The adjustment member 47 is fixed to the upper part of the case main body 43*a*. The adjustment member 47 extends in a left-right direction.

Areas 140 that face a rotation plane (side surface (curved surface)) of the developing roller 50 are present at both left and right end parts of the case main body 43*a*. A case-side side seal member 150 is attached to each of the facing areas 140 of the case main body 43*a*. Further, areas 142 that face the rotation plane of the developing roller 50 are also present at both left and right end parts of the adjustment member 47. An adjustment member-side side seal member 152 is attached to each of the facing areas 142 of the adjustment member 47.

The facing areas 140 of the case main body 43*a* and the facing areas 142 of the adjustment member 47 are aligned above and below. The facing areas 140 of the case main body 43*a* are formed at an upstream side in the rotation direction of the developing roller 50, and the facing areas 142 of the adjustment member 47 are formed at a downstream side in the rotation direction of the developing roller 50.

Figure 5:
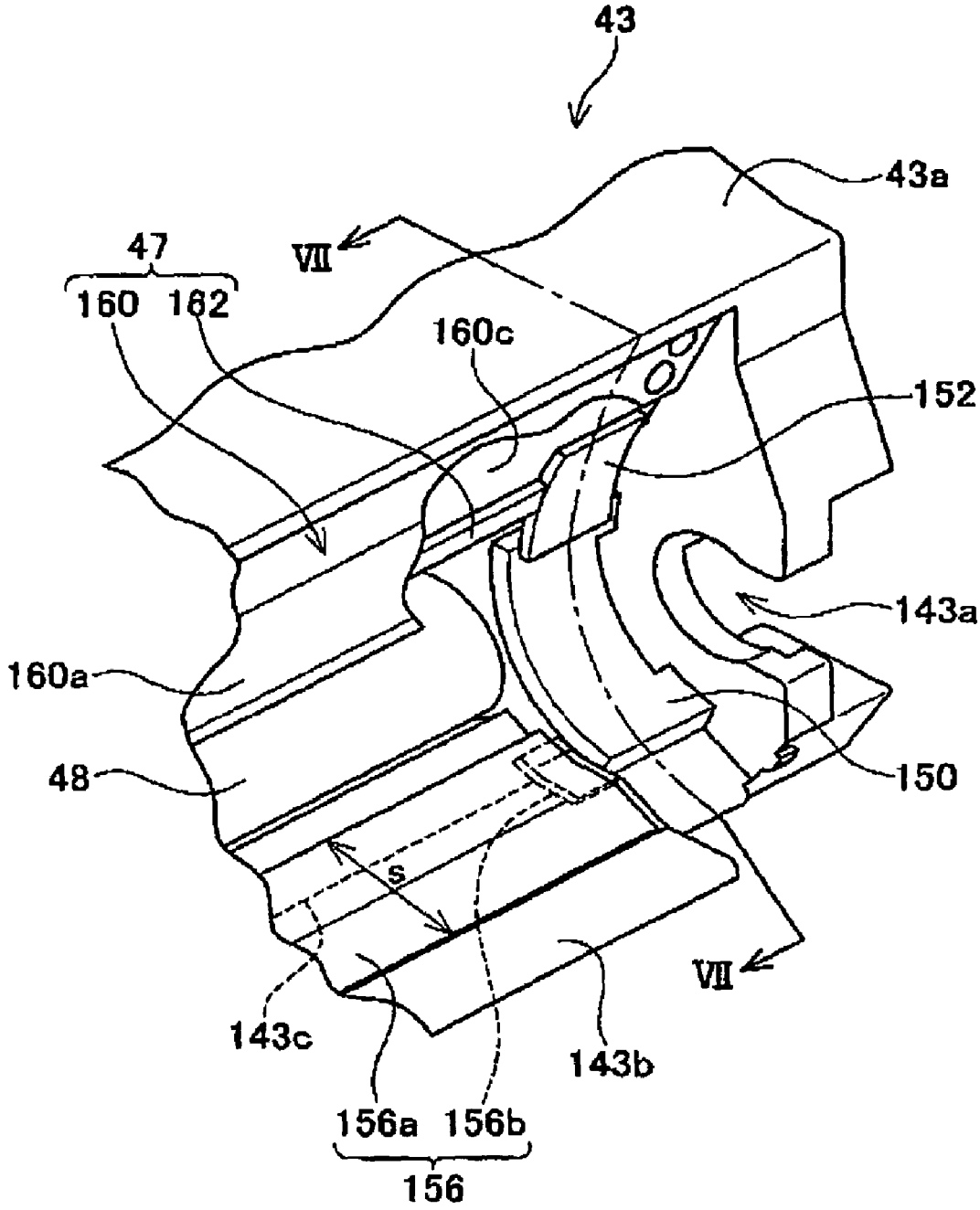
FIG. 5 shows a perspective view of an end part of the developer cartridge.

FIG. 5 shows a perspective view of the surroundings of a right end pat (the right end part of FIG. 4) of the developer cartridge 43. The configuration of the right end part of the developer cartridge 43 will be described in detail. The left end part of the developer cartridge 43 is a symmetrical mirror image of the right end part of the developer cartridge 43, and consequently a detailed description thereof is omitted. Furthermore, a part of a frame member 160*a* (to be described) has been cut away in FIG. 5 so that the configuration of the adjustment member 47 is clear.

The developing roller 50 is not shown in FIG. 5. A hole part 143*a* for supporting the developing roller 50 is formed in the right end part of the case main body 43*a*. The developing roller axis 50*b* (see FIG. 2) extends to the exterior past the hole part 143*a* (toward the right in FIG. 5).

A front side frame 143*b* is formed at the bottom part of the case main body 43*a*. An axial direction seal member 156 joins with the front side frame 143*b*. The axial direction seal member 156 comprises an axial direction seal part 156*a* and a rotation direction seal part 156*b*. The axial direction seal part 156*a* is thin and film shaped, and is made from polyethylene terephthalate (PET). The axial direction seal part 156*a* extends in the rotation axis direction of the developing roller 50. It can be seen clearly in FIG. 4 how the axial direction seal part 156*a* extends in the rotation axis direction (the left-right direction). Further, the axial direction seal part 156*a* has a vertical width having the range shown by the arrow S in FIG. 5. A part of the front side frame 143*b* beyond the reference number 143*c* upwards and to the left of FIG. 5 bends downwards. The axial direction seal part 156*a* extends past the part 143*c* of the front side frame 143*b* towards the posterior. That is, the axial direction seal part 156*a* has a floating part that does not make contact with the front side frame 143*b*. The rotation direction seal part 156*b* is short in the rotation axis direction of the developing roller 50, and long in the rotation direction of the developing roller 50. The rotation direction seal part 156*b* is disposed between the axial direction seal part 156*a* and the front side frame 143*b*. The rotation direction seal part 156*b* joins with the front side frame 143*b*. An outer side surface (a right side surface in FIG. 5) of the rotation direction seal part 156*b* protrudes outwards (to the right in FIG. 5) beyond an outer side surface of the axial direction seal part 156*a*. The outer side surface of the rotation direction seal part 156*b* makes contact with an inner side surface of the case-side side seal member 150. The rotation plane of the developing roller 50 makes contact with the axial direction seal part 156*a*. Further, the rotation plane of the developing roller 50 also makes contact with the rotation direction seal part 156*b* of the pant protruding from the axial direction seal part 156*a* A seal is formed between the lower part of the developing roller 50 and the case main body 43*a* by the developing roller 50 making contact with the axial direction seal part 156*a* and the rotation direction seal part 156*b*.

The case-side side seal member 150 and the adjustment member-side side seal member 152 each have an arc shape. This shape is shown clearly in FIG. 6.

Figure 6:
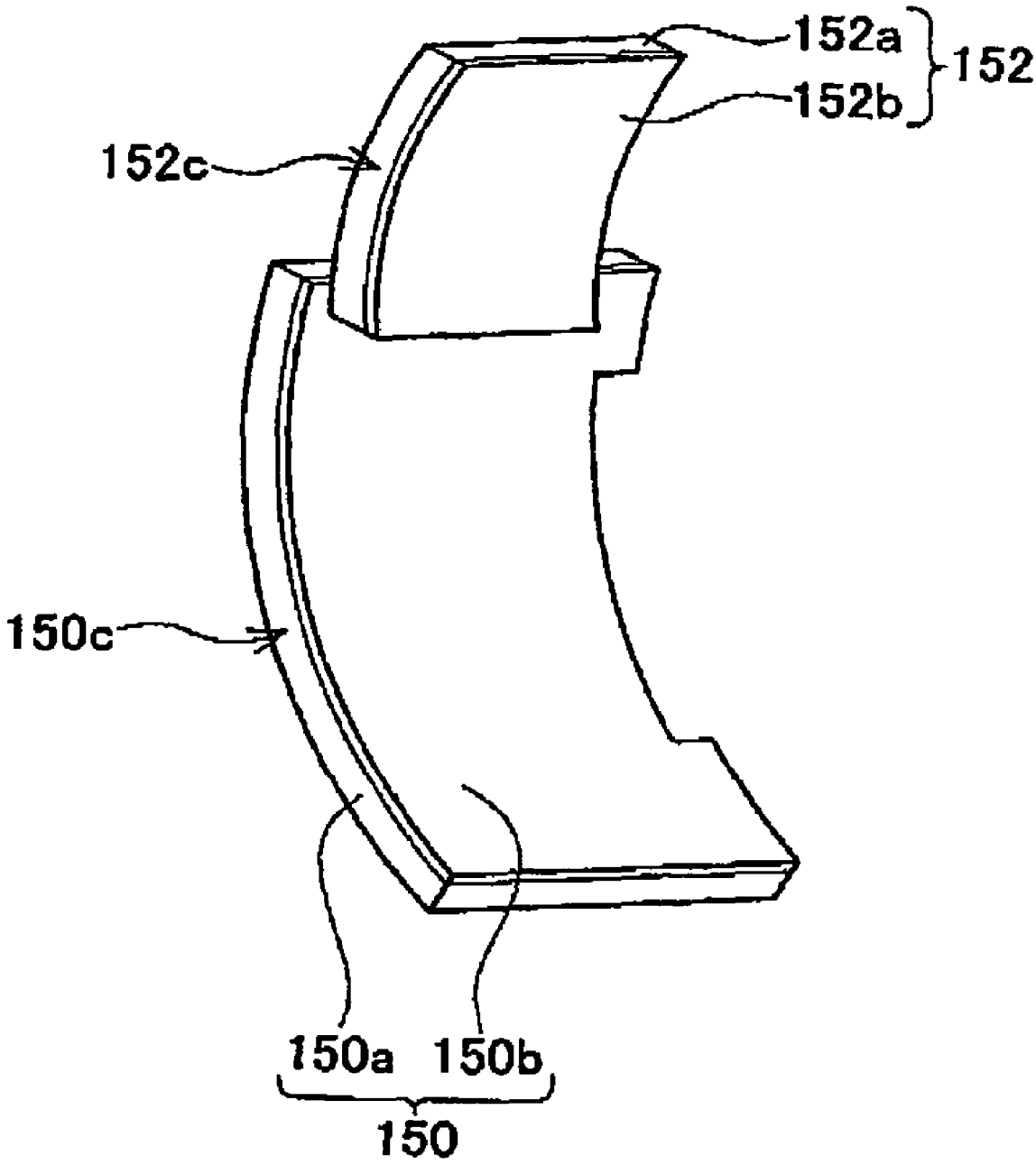
FIG. 6 shows a perspective view of a side seal member.

FIG. 6 is a perspective view showing only the case-side side seal member 150 and the adjustment member-side side seal member 152. The case-side side seal member 150 has a two layered configuration A bottom layer 150*a* of the case-side side seal member 150 joins with the facing areas 140 (see FIG. 4) of the case main body 43*a*. The bottom layer 150*a* is configured with a sponge. A top layer 150*b* of the case-side side seal member 150 joins with the bottom layer 150*a*. The top layer 150*b* is configured with a felt. The top layer 150*b* makes contact with the rotation plane of the developing roller 50.

The adjustment member-side side seal member 152 also has a two layered configuration. A bottom layer 152*a* of the adjustment member-side side seal member 152 joins with the facing areas 142 (see FIG. 4) of the adjustment member 47. The bottom layer 152*a* is configured with a sponge. A top layer 152*b* of the adjustment member-side side seal member 152 joins with the bottom layer 152*a*. The top layer 152*b* is configured with a felt. The top layer 152*b* makes contact with the rotation plane of the developing roller 50.

Since the bottom layer 150*a* of the case-side side seal member 150 and the bottom layer 152*a* of the adjustment member-side side seal member 152 are made from sponge that can bend flexibly, both the top layers 150*b* and 152*b* can be pushed strongly against the developing roller 50. A highly effective seal can thus be obtained.

As shown in FIG. 6, a part of the adjustment member-side side seal member 152 overlaps with an upper surface of the case-side side seal member 150. Furthermore, in the rotation axis direction of the developing roller 50 (in the left-right direction of FIG. 6), the inner side surface 150*c* (the left side surface in FIG. 6) of the case-side side seal member 150 is located further inwards than an inner side surface 152*c* of the adjustment member-side side seal member 152.

Figure 7:
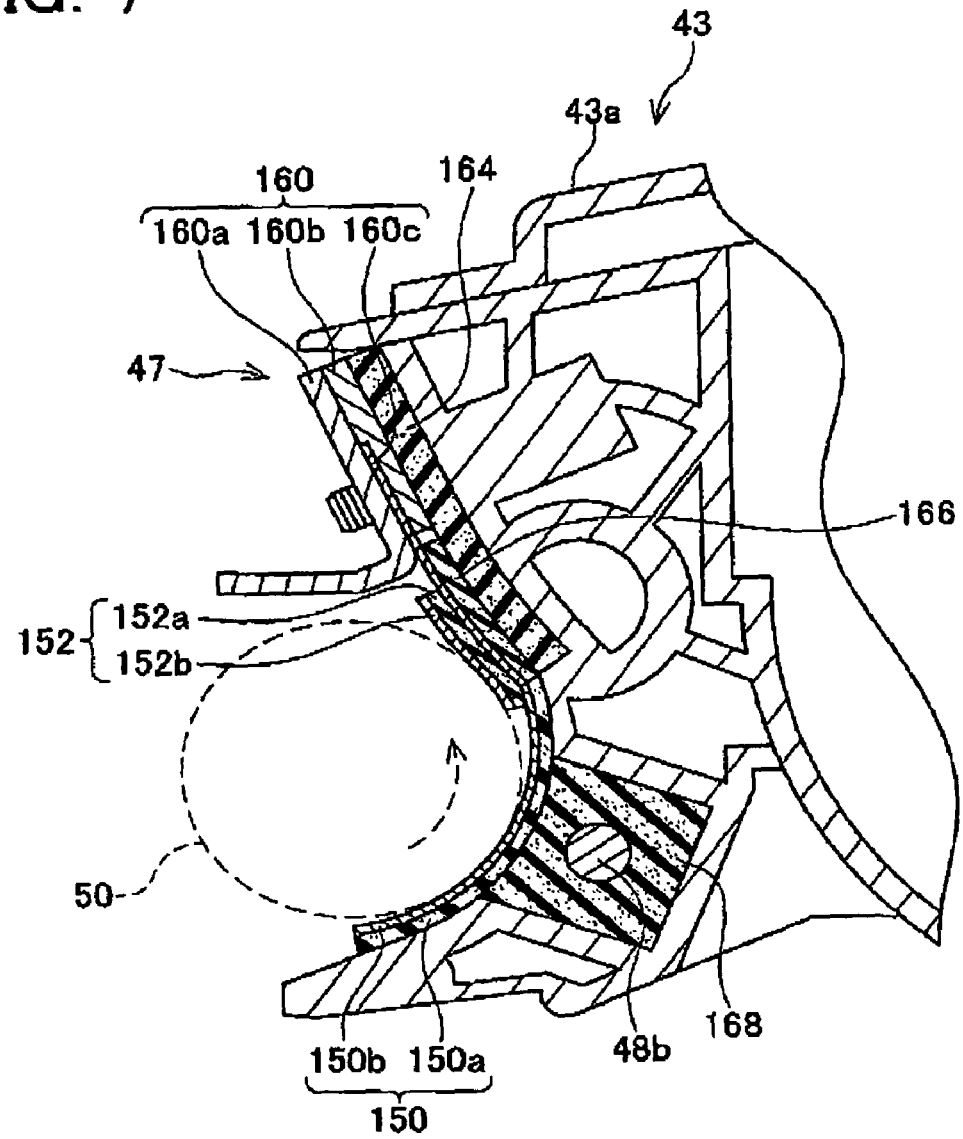
FIG. 7 shows a cross-sectional view along the line VII-VII of FIG. 5.

FIG. 7 shows a cross-sectional view along the line VII-VII of FIG. 5. The configuration of the adjustment member 47 will be described in detail with reference to FIG. 7. In FIG. 7, the developing roller 50 is shown by a broken line. The arrow with a broken line shows the rotation direction of the developing roller 50.

The adjustment member 47 comprises a support member 160. The support member 160 supports a contact member 162 that makes contact with the developing roller 50. The contact member 162 cannot be seen in the cross-sectional view of FIG. 7, but is shown in FIG. 5. The contact member 162 extends in the rotation axis direction of the developing roller 50, and makes contact with substantially the entire area thereof along the rotation axis direction. The contact member 162 is made from silicon rubber.

The support member 160 comprises two frame members 160*a* and 160*b*, and a stainless steel plate 160*c*. The front side (at the left side in FIG. 7) frame member 160*a* is substantially L-shaped. The stainless steel plate 160*c* is gripped between the front side frame member 160*a* and the back side frame member 160*b*. The two frame members 160*a*, 160*b* and the stainless steel plate 160*c* extend in the rotation axis direction of the developing roller 50 (in the direction perpendicular to the plane of the page of FIG. 7). As shown in FIG. 5, the contact member 162 is joined with the stainless steel plate 160*c*. The contact member 162 is not joined with the left and right end parts (the left and right end parts in FIG. 4) of the stainless steel plate 160*c*. The adjustment member-side side seal members 152 are joined with these end parts.

The adjustment member-side side seal member 152 extends downward beyond the stainless steel plate 160*c*. This part that extends downward overlaps with the case-side side seal member 150. The case-side side seal member 150 and the adjustment member-side side seal member 152 are joined at this overlapping part.

A sponge member 164 is disposed between the case main body 43*a* and the back side frame member 160*b*. The sponge member 164 extends in the rotation axis direction of the developing roller 50. The sponge member 164 creates a seal between the case main body 43*a* and the frame member 160*b*. A sponge member 166 is disposed between the sponge member 164 and the stainless steel plate 160*c*. This sponge member 166 also extends in the rotation axis direction of the developing roller 50, and functions as a seal. Below, the sponge member 164 and the sponge member 166 will be referred to together as middle seal members 164 and 166.

An elastic member 168 (for example, a sponge) is disposed at a lower part of the case main body 43*a* and is set around the periphery of the supply roller axis 48*b*. The case-side side seal member 150 also joins with the sponge 168.

The configuration of the process cartridge 40 has been described in detail Next, the operation of the process carridge 40 will be described with reference to FIG. 2.

The toner of the toner chamber 45 adheres to the supply roller 48. The toner that has adhered to the supply roller 48 becomes positively charged due to friction between the supply roller 48 and the developing roller 50. The positively charged toner covers the surface of the developing roller 50. The contact member 162 (see FIG. 5) of the adjustment member 47 makes contact with the layer of toner on the surface of the developing roller 50. The layer of toner is thus adjusted to have a constant thickness. Further, the non-magnetic mono-component toner of the present embodiment can be charged satisfactorily because the contact member 162 is made from silicon rubber.

The surface of the photoreceptor drum main body 54*a* is positively charged by the charger 66. The surface of the photoreceptor drum main body 54*a* that has been positively charged receives the light of the laser beams emitted from the exposure device 70 (see FIG. 1). A predetermined part of the surface of the photoreceptor drum main body 54*a* is thus exposed. The voltage of the exposed part of the photoreceptor drum main body 54*a* decreases. The part that is exposed varies based on the content to be printed. An electrostatic latent image is formed on the photoreceptor drum main body 54*a* based on the content to be printed.

The toner covering the developing roller 50 adheres to the exposed part of the photoreceptor drum main body 54*a*. The toner does not adhere to the part of the photoreceptor drum main body 54*a* that was not exposed. The electrostatic latent image formed on the photoreceptor drum main body 54*a* thus becomes visible. Since the layer of toner on the developing roller 50 is maintained at a constant thickness by the adjustment member 47, a visible image that has the same thickness is developed on the photoreceptor drum main body 54*a*.

The visible image that is being supported on the photoreceptor drum main body 54*a* is transferred to the printing paper that is located between the photoreceptor drum 54 and the transfer roller 52. Bias is applied to the transfer roller 52. The voltage difference between the photoreceptor drum 54 and the transfer roller 52 transfers the toner to the printing paper. Since the visible image developed on the photoreceptor drum main body 54*a* has the same thickness, the toner is transferred to the printing paper with the same density. Printing density is thus kept constant.

A desired image (words or pictures) is printed on the printing paper by means of the above process.

The printer 10 of the present embodiment has been described in detail. In the printer 10, the case-side side seal member 150 and the adjustment member-side side seal member 152 are configured separately. The case-side side seal member 150 and the adjustment member-side side seal member 152 that are configured separately can be mounted separately at the facing area 140 of the case main body 43*a* and the facing area 142 of the adjustment member 47. As a result, attachment of the side seal members 150 and 152 in an unintended position or an unintended shape can be prevented effectively. Although the two side seal members 150 and 152 are configured separately, they make contact without a space therebetween in the rotation direction of the developing roller 50. As a result, a highly effective seal can be obtained. The developer cartridge 43 has an extremely effective seal.

It is preferred that, with the case-side side seal member 150, the bottom layer 150*a* and the top layer 150*b* are joined together first, and then the case-side side seal member 150 is joined to the case main body 43*a*. When the bottom layer 150*a* and the top layer 150*b* are joined together first, the case-side side seal member 150 can be joined better to the case main body 43*a* than in the case where only the bottom layer 150*a* is first joined to the case main body 43*a* and then the top layer 150*b* is joined. Similarly, it is preferred that with the adjustment member-side side seal member 152, the bottom layer 152*a* and the top layer 152*b* are joined together first, and then the adjustment member-side side seal member 152 is joined to the adjustment member 47.

In the above embodiment, a part of the adjustment member-side side seal member 152 overlaps with the case-side side seal member 150. According to the research of the present inventors, this type of overlapping improves the effectiveness of the seal. That is, theme is a tight seal between the two side seal members 150 and 152, and consequently toner can be prevented from leaking out from between these two side seal members 150 and 152. Further, the overlapping parts of the case-side side seal member 150 and the adjustment member-side side seal member 152 are bonded together. As a result, the adjustment member-side side seal member 152 is fixed firmly.

Figure 8:
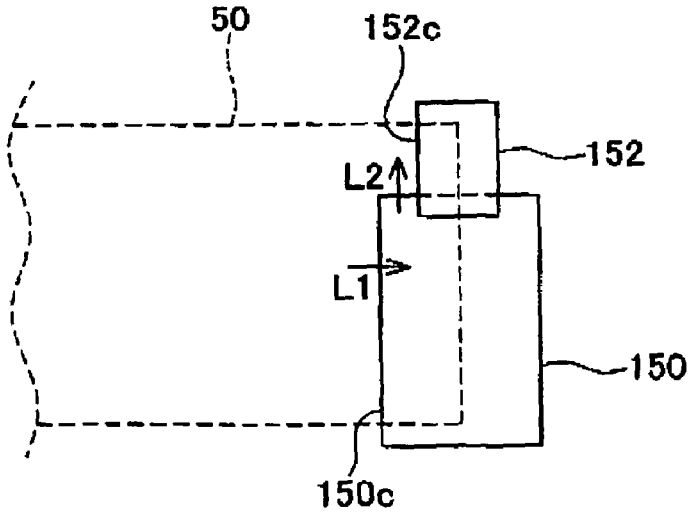
FIG. 8 shows a simplified view of a case-side side seal member and an adjustment member-side side seal member.

Moreover, as shown in FIG. 6, the inner side surface 150*c* of the case-side side seal member 150 is located further inwards than the inner side surface 152*c* of the adjustment member-side side seal member 152. The sealing effectiveness that is obtained by utilizing this type of configuration will be described with reference to FIG. 8. FIG. 8 is a simplified plan view of the case-side side seal member 150 and the adjustment member-side side seal member 152. The broken line in the figure is the developing roller 50. If toner enters between the case-side side seal member 150 and the case main body 43*a* (in the direction of the arrow L1), this toner moves downstream as the developing roller 50 rotates (in the direction of the arrow L2). Since the inner side surface 150*c* of the case-side side seal member 150 is further inwards than the inner side surface 152*c* of the adjustment member-side side seal member 152, the toner exits from the downstream end (the top end in FIG. 8) of the case-side side seal member 150 into the case main body 43*a*, as shown by the arrow L2. If the inner side surface 150*c* of the case-side side seal member 150 were not located further inwards, the toner that has moved in the direction of the arrow L2 would enter between the adjustment member 47 and the adjustment member-side side seal member 152. In this case, the toner would frequently leak from the downstream end or right end of the adjustment member-side side seal member 152 to the exterior of the case main body 43*a*. It is difficult for the toner to enter between the adjustment member 47 and the adjustment member-side side seal member 152 in the present embodiment, and consequently the toner does not readily leak. An extremely effective seal can be obtained in the printer 10 of the present embodiment. Since the seal is highly effective, non-magnetic mono-component toner that leaks comparatively readily can be used.

A specific example of an embodiment of the present invention is presented above, but this is merely an example and does not restrict the claims thereof. The technique set forth in the claims includes various transformations and modifications of the example set forth above.

For example, the adjustment member-side side seal member 152 in the above embodiment is joined with the stainless steel plate 160*c* of the adjustment member 47. FIG. 9(*a*) shows this in a simplified manner. In FIG. 9(*a*), a bottom end 160*d* (an end part at the upstream end in the rotation direction of the developing roller 50) of the stainless steel plate 160*c* is slightly above a bottom end of the adjustment member-side side seal member 152. This can be varied as shown in FIGS. 9(*b*) to 9(*e*).

In FIG. 9(*b*), the bottom end 160*d* of the stainless steel plate 160*c* has been shifted upwards. The adjustment member-side side seal member 152 extends past the bottom end 160*d* of the stainless steel plate 160*c* and extends downwards for a considerable distance. A part of this downwardly extending portion joins with the case-side side seal member 150. The remaining part of the downwardly extending portion joins with the middle seal members 164 and 166 (see FIG. 7). When this is done, the adjustment member-side side seal member 152 can be joined firmly.

In FIG. 9(*c*), a part of the bottom end 160*d* of the stainless steel plate 160*c* is notched obliquely. The adjustment member-side side seal member 152 joins with the middle seal members 164 and 166 at this notched portion of the stainless steel plate 160*c*.

In FIG. 9(*d*), a hole 160*e* is formed in the stainless steel plate 160*c*. The adjustment member-side side seal member 152 joins with the middle seal members 164 and 166 via the hole 160*e* of the stainless steel plate 160*c*.

In FIG. 9(*e*), the entire adjustment member-side side seal member 152 has been shifted downwards. The majority of the adjustment member-side side seal member 152 can be joined with the case-side side seal member 150. Even when this is done, the adjustment member-side side seal member 152 can be joined firmly.

Further, as shown in FIG. 10, a case-side side seal member 240 may be formed from an upstream-side side seal member 250 and a downstream-side side seal member 252. The upstream-side side seal member 250 and the downstream-side side seal member 252 are configured separately, but make contact with one another.

When this configuration is utilized, the case-side side seal member 240 can be joined effectively to the case main body 43*a*. It is preferred that this configuration is utilized when the case-side side seal member 240 is long in the rotation direction of the developing roller 50.

In the present variation, also, a part of the downstream-side side seal member 252 may overlap with the upstream-side side seal member 250. Further, it is preferred that an inner side surface 250*c* of the upstream-side side seal member 250 is further inwards (the left direction of FIG. 10) than an inner side surface 252*c* of the downstream-side side seal member 252. In this case, a highly effective seal can be obtained.

Furthermore, the technical elements disclosed in the present specification or figures have technical utility both separately and in all types of conjunctions and are not limited to the conjunctions set forth in the claims at the time of filing this application. Furthermore, the technique disclosed in the present specification or figures may be utilized to simultaneously realize a plurality of aims or to realize one of these aims.

What is claimed is:

1. A developing device, comprising:

a case main body comprising an opening;

a developing roller coupled with the case main body at a position facing the opening, the developing roller capable of rotating and supporting developer housed in the case main body;

an adjustment member coupled with the case main body and extending along a rotation axis direction of the developing roller, the adjustment member adjusting the thickness of the developer supported by the developing roller; and a side seal member, wherein the case main body comprises a first area facing a rotation plane of the developing roller, the adjustment member comprises a second area facing the rotation plane of the developing roller, the first area and the second area are aligned along a rotation direction of the developing roller, the side seal member comprises a first seal member mounted on the first area and making contact with the rotation plane of the developing roller, and a second seal member mounted on the second area and making contact with the rotation plane of the developing roller, the first seal member and the second seal member are configured separately and make contact with one another, and a part of the second seal member overlaps with an upper surface of the first seal member, and the part of the second seal member is located between the rotation plane of the developing roller and the upper surface of the first seal member.

2. The developing device as in claim 1, wherein the first seal member comprises a first elastic member mounted on the first area, and a first contact member mounted on an upper surface of the first elastic member, the first contact member making contact with the rotation plane of the developing roller, and the second seal member comprises a second elastic member mounted on the second area, and a second contact member mounted on an upper surface of the second elastic member, the second contact member making contact with the rotation plane of the developing roller.

3. The developing device as in claim 1, wherein the first seal member is located at an upstream side in the rotation direction of the developing roller, and the second seal member is located at a downstream side in the rotation direction of the developing roller.

4. The developing device as in claim 3, wherein, in the rotation axis direction of the developing roller, an inner side surface of the first seal member is located inward with respect to an inner side surface of the second seal member.

5. The developing device as in claim 1, wherein the adjustment member comprises a first adjustment member making contact with the developer supported by the developing roller, and a second adjustment member supporting the first adjustment member and coupled with the case main body.

6. The developing device as in claim 5, wherein the second adjustment member comprises a plate member supporting the first adjustment member, and a member supporting the plate member and coupled with the case main body.

7. The developing device as in claim 6, wherein the plate member comprises the second area, and the second seal member is mounted on the plate member.

8. The developing device as in claim 5, wherein the first adjustment member is formed from silicon rubber.

9. The developing device as in claim 1, further comprising:

a middle seal member located between the case main body and the adjustment member, the middle seal member extending along the rotation axis direction of the developing roller, and sealing between the case main body and the adjustment member.

10. The developing device as in claim 9, wherein a part of the second seal member is connected with the middle seal member.

11. The developing device as in claim 10, wherein the adjustment member comprises a first adjustment member making contact with the developer supported by the developing roller, and a second adjustment member supporting the first adjustment member and coupled with the case main body, the second adjustment member comprises a plate member supporting the first adjustment member, and a member supporting the plate member and coupled with the case main body, the plate member comprises the second area and a through hole located in the second area, the second seal member is mounted on the second area of the plate member, the part of the second seal member is connected with the middle seal member via the through hole.

12. The developing device as in claim 1, comprising:

a pair of the first seal members, and a pair of the second seal members, wherein the case main body comprises a pair of the first areas, one of the first areas being located at one end side in the rotation axis direction of the developing roller, and the other of the first areas being located at the other end side in the rotation axis direction of the developing roller, the adjustment member comprises a pair of the second areas, one of the second areas being located at one end side in the rotation axis direction of the developing roller, and the other of the second areas being located at the other end side in the rotation axis direction of the developing roller, one of the first seal members is mounted on one of the first areas, the other of the first seal members is mounted on the other of the first areas, one of the second seal members is mounted on one of the second areas, and the other of the second seal members is mounted on the other of the second areas.

13. The developing device as in claim 1, wherein the developing roller bas a substantially cylindrical shape, and the rotation plane of the developing roller is a cylindrical plane.

14. The developing device as in claim 1, wherein the developer is a non-magnetic mono-component polymerization toner.

15. The developing device as in claim 1, wherein the developing device is a developer cartridge capable of being removably attached to an image forming device which forms an image by utilizing the developer.

16. A process cartridge capable of being removably attached to an image forming device which forms an image by utilizing developer, the process cartridge comprising:

a photoreceptor and the developing device as in claim 1, wherein the developer supported by the developing roller of the developing device is supplied to a surface of the photoreceptor.

17. An image forming device which forms an image on a recording medium by utilizing developer the image forming device comprising:

a photoreceptor and the developing device as in claim 1, wherein the developer supported by the developing roller of the developing device is supplied to a surface of the photoreceptor, and the developer supplied to the surface of the photoreceptor is transferred to the recording medium.

18. A developing device, comprising:

a case main body comprising an opening;

a developing roller coupled with the case main body at a position facing the opening, the developing roller capable of rotating and supporting developer housed in the case main body; and a seal member, wherein the case main body comprises an upstream area facing a rotation plane of the developing roller, and a downstream area facing the rotation plane of the developing roller, the upstream area being located at an upstream side in the rotation direction of the developing roller, and the downstream area being located at a downstream side in the rotation direction of the developing roller, the seal member comprises an upstream seal member mounted on the upstream area and making contact with the rotation plane of the developing roller, and a downstream seal member mounted on the downstream area and making contact with the rotation plane of the developing roller, the upstream seal member and the downstream seal member are configured separately and make contact with one another, and a part of the second seal member overlaps with an upper surface of the first seal member, and the part of the second seal member is located between the rotation plane of the developing roller and the upper surface of the first seal member.

19. A method of manufacturing a developing device, comprising:

preparing a case main body comprising an opening, a developing roller for supporting developer housed in the case main body, an adjustment member for adjusting the thickness of the developer supported by the developing roller, a first seal member, and a second seal member, wherein the first seal member and the second seal member are configured separately;

coupling the adjustment member with the case main body;

bonding the first seal member to a first area of the case main body;

bonding the second seal member to a second area of the adjustment member such that the first seal member and the second seal member make contact with one another, and a part of the second seal member overlaps with an upper surface of the first seal member; and coupling the developing roller with the case main body at a position facing the opening such that a rotation plane of the developing roller makes contact with the first seal member and the rotation plane of the developing roller makes contact with the second seal member, and the part of the second seal member is located between the rotation plane of the developing roller and the upper surface of the first seal member.

20. The method as in claim 19, wherein the first seal member comprises a first elastic member and a first contact member, the second seal member comprises a second elastic member and a second contact member, the preparing step comprises a step of bonding the first contact member with an upper surface of the first elastic member, and a step of bonding the second contact member with an upper surface of the second elastic member, a bottom surface of the first elastic member is bonded to the first area of the case main body, and a bottom surface of the second elastic member is bonded to the second area of the adjustment member.

* * * * *

UNITED STATES PATENT AND TRADEMARK OFFICE

CERTIFICATE OF CORRECTION

PATENT NO. : 7,630,666 B2
APPLICATION NO. : 11/527726
DATED : December 8, 2009
INVENTOR(S) : Nakaya et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 285 days.

Signed and Sealed this

Second Day of November, 2010

David J. Kappos

David J. Kappos
*Director of the United States Patent and Trademark Office*